US005297883A

United States Patent [19]

Ozu

[11] Patent Number: 5,297,883

[45] Date of Patent: Mar. 29, 1994

[54] LIQUID APPLICATOR WITH DRYING PREVENTION AGENT

[75] Inventor: Tatsuya Ozu, Kadoma, Japan

[73] Assignee: Kabushiki Kaisha Sakura Kurepasu, Osaka, Japan

[21] Appl. No.: 983,752

[22] Filed: Dec. 1, 1992

[30] Foreign Application Priority Data

Dec. 10, 1991 [JP] Japan ..... 3-109568[U]
Dec. 10, 1991 [JP] Japan ..... 3-109569[U]
Aug. 10, 1992 [JP] Japan ..... 4-213039

[51] Int. Cl.[5] ..... B43K 9/00; B43K 8/02; B43K 7/00

[52] U.S. Cl. ..... 401/202; 401/199; 401/213; 401/243; 401/269

[58] Field of Search ..... 401/202, 199, 213, 243, 401/269

[56] References Cited

U.S. PATENT DOCUMENTS 2,673,362 3/1954 Robinson .
3,003,182 10/1961 Rosenthal ..... 401/199 X
3,463,597 8/1969 Wakai ..... 401/202 X
4,221,493 9/1980 Cole et al. ..... 401/199
4,496,258 1/1985 Tanaka et al. ..... 401/199 X
4,588,319 5/1986 Niemeyer ..... 401/199 X
4,911,571 3/1990 Inoue et al. ..... 401/202
5,163,767 11/1992 Lucas ..... 401/202

FOREIGN PATENT DOCUMENTS 3223722 12/1983 Fed. Rep. of Germany ..... 401/202
1461488 12/1966 France ..... 401/202
2135247 8/1984 United Kingdom .

*Primary Examiner*—Steven A. Bratlie
*Attorney, Agent, or Firm*—Fish & Richardson

[57] ABSTRACT

A hollow inner cylinder is provided in a lead end portion of a casing, and a pen shaft is inserted into the inner cylinder. The inner cylinder is connected to the casing through a partition wall having communication holes formed herein. In an annular space defined between the inner cylinder and the casing and located below the partition wall is filled an impregnation receptacle holding a dry preventing agent for preventing a nib from getting dried. The liquid applicator thus constructed is capable of effectively suppressing the drying of the nib without affecting the performance of liquid to be applied.

12 Claims, 6 Drawing Sheets

LIQUID APPLICATOR WITH DRYING PREVENTION AGENT

BACKGROUND OF THE INVENTION

This invention relates liquid applicators including felt pens, paint markers, and ball-point pens.

Generally, when a liquid applicator containing, in a casing thereof, liquid to be applied, for example, a ball-point pen containing ink therein, is left uncapped for a long time, volatile components of the ink introduced to a nib of the applicator evaporate into the air and the ink is condensed and solidified at the nib, thereafter becoming a hindrance to ink flow during writing. Thus, the above liquid applicator suffers from the so-called scratching phenomenon problem.

In view of this problem, it has been conventionally attempted to suppress the condensation and solidification of the ink by adding wetting agents such as ethylene glycol and polyethylene glycol, thereby preventing the nib from drying.

In general, since wetting agents added to ink cause blotting in one's hands, reduction in the density of written lines, stenographic performance and ink flow, their use is subject to limitation. Accordingly, it cannot be expected that addition of wetting agents to ink will bring about remarkable effects. In recent years, pigment ink which has excellent light, water, and chemical resistance has been frequently used in the above liquid applicator. However, the nib of the liquid applicator is particularly liable to dry with the pigment ink. Thus, it is expected to provide a means capable of effectively preventing the nib from drying.

SUMMARY OF THE INVENTION

In view of the problems residing in the prior art, it is an object of the invention to provide a liquid applicator capable of effectively preventing a lead end portion thereof or nib from becoming dry without adversely affecting the performance of the liquid to be applied.

Accordingly, a liquid applicator of the invention comprises a main body container for containing liquid to be applied; an applicator shaft mounted in lead end portion of the main body container and adapted for introducing the liquid to be applied to a nib thereof; a cap mountable on the main body container so as to cover the nib of the applicator shaft; and a mass of dry prevention agent which has a volatile property and whose vapors are used in preventing the nib of the applicator shaft from drying, the mass of dry prevention agent being provided at a specified position around the applicator shaft in the main body container in such a manner that the vapors of the dry prevention agent ooze toward the nib of the applicator shaft.

Even if the liquid applicator thus constructed is left uncapped for a long time, the vapors of the dry prevention agent provided in the lead end portion of the main body container cover the surface of the lead end of the applicator shaft, thereby suppressing evaporation of the solvent of the liquid to be applied into the air. This prevents the drying of the lead end of the applicator shaft. Further, provision of the dry preventing agent has almost no influence on the performance of the liquid to be applied since the dry prevention agent is not directly mixed with the liquid contained in the main body container.

The dry preventing agent preferably consists of at least one component of the liquid to be applied because the influence it has on the liquid to be applied can be suppressed more reliably.

It may be appropriate to impregnate the dry preventing agent in an impregnation receptacle and to dispose the impregnation receptacle at the specified position around the applicator shaft. The impregnation receptacle is preferably formed by any one of a high water absorptive resin, a porous high water absorptive resin, a fibrous filter, a porous high molecular resin containing the high water absorptive resin therein, and a fibrous filter containing a high water absorptive resin therein. In this case, the dry preventing agent evaporates from the impregnation receptacle. Particularly, being formed of any one of the above listed materials, the impregnation receptacle has an improved capability of holding the dry preventing agent, and accordingly the amount of the dry preventing agent held thereby can be increased. It is also appropriate to provide the dry preventing agent in a gelatinized state at the specified position around the applicator shaft. With this, the impregnation receptacle is dispensed with since the gelatinized dry preventing agent is provided as it is, and the dry preventing agent is not scattered even if an impact is given thereon such as when the liquid applicator falls inadvertently.

As for the position where the dry preventing agent is filled, it is advantageous to form a recessed portion in the lead end portion of the main body container at a position spaced away from the applicator shaft, and to fill the dry preventing agent in thus formed recessed portion. More specifically, a hollow inner cylinder is provided in the lead end portion of the main body container, thereby defining an annular space opening toward the lead end of the liquid applicator between the inner cylinder and the main body container. The applicator shaft is inserted into the inner cylinder, and the inner cylinder and the main body container are connected to each other through a partition wall for separating the annular space into a lead annular space located above the partition wall and a bottom annular space located below the partition wall. It is preferable to fill the dry preventing agent in the recessed portion which is formed by the inner cylinder, the main body container, and the partition wall and defines the lead annular space.

With this arrangement, since the applicator shaft is spaced away from the dry preventing agent, it can be prevented more reliably than when the dry preventing agent is mixed with the liquid to be applied impregnated in the applicator shaft.

Further, communication means may be provided in the partition wall for communicating between the lead annular space and the bottom annular space. If the dry preventing agent is filled in at least one of the lead annular space and the bottom annular space, a further effective liquid applicator is obtainable.

With this arrangement, the mass of dry preventing agent is in communication with an interior of the main body container. Thus, evaporation of the liquid contained in the main body container can be suppressed by the presence of the vapors of the dry preventing agent.

The cap may include a hollow outer cylindrical portion to be fitted to an outer circumferential surface of the main body container and a hollow inner cylindrical portion positioned more radially inward than the outer cylindrical portion. The inner cylindrical portion is made insertable into the annular space defined in the main body container, and the outside diameter of the inner cylindrical portion is set such that an outer circumferential surface of the inner cylindrical portion is sealably in contact with an inner circumferential surface of the main body container facing the annular space in a state where the outer cylindrical portion is fitted to the outer circumferential surface of the main body container.

With this arrangement, since the outer circumferential surface of the inner cylindrical portion of the cap is sealably in contact with the inner circumferential surface of the casing facing the annular space, the lead end of the applicator shaft and the dry preventing agent can be held airtight.

Further, a covering portion extending up to the vicinity of the lead end of the liquid applicator may be provided at a lead end of the main body container, the covering portion being formed such that the diameter thereof decreases as it extends toward the lead end of the liquid applicator. With a thus formed covering portion, the vapors of the dry preventing agent can be introduced to the lead end of the applicator shaft actively.

These and other objects, features and advantages of the present invention will become more apparent upon a reading of the following detailed description and accompanying drawings.

DESCRIPTION OF THE PREFERRED EMBODIMENTS

Figure 1:
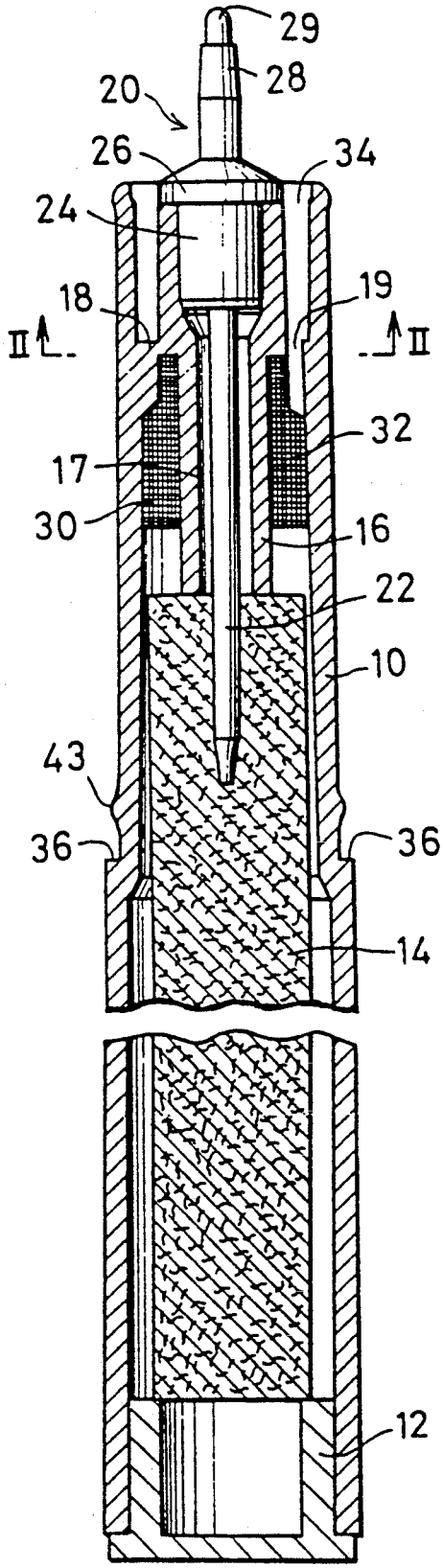
FIG. 1 is a front view in section showing a first liquid applicator embodying the invention.
Figure 2:
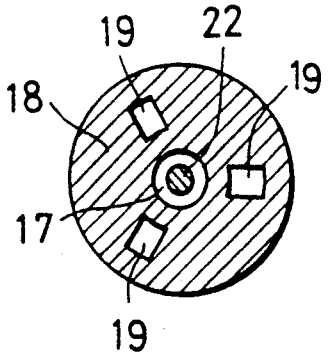
FIG. 2 is a sectional view taken along the line II—II in FIG. 1.

A first embodiment of the invention will be described with reference to FIGS. 1 to 3.

An illustrated applicator is provided with a casing 10 at a bottom of which is mounted a bottom cap 12. The casing 10 and the bottom cap 12 constitute a main body container according to the invention. IN the casing 10 is contained an ink reservoir 14.

Inside a leading end portion of the casing 10 is provided a hollow inner cylinder 16 concentrically with the casing 10. Between the inner cylinder 16 and the casing 10 is defined an annular space. A bottom end of the inner cylinder 16 is held in contact with the ink reservoir 14, to thereby position the ink reservoir 14. The inner cylinder 16 is connected to the casing 10 through a partition wall 18 as shown in FIG. 2. In the partition wall 18 are formed a plurality of communication holes (communication means) 19 for communicating a bottom annular space 32 defined below the wall 18 and a lead annular space 34 defined above the wall 18.

A pen shaft (applicator shaft) 20 is inserted into an inner hold 17 defined inside the inner cylinder 16. This pen shaft 20 is provided with a pen core 22, a mount fitting 24, a jaw portion 26, and a lead fitting 28 in this order from a bottom thereof. A nib 29 projects out of a lead end of the lead fitting 28. The mount fitting 24 is pressingly inserted into the inner hold 17 until the jaw portion 26 comes to contact with a lead end face of the inner cylinder 16. In this state, the pen core 22 is connected with the ink reservoir 14.

An annular impregnation receptacle 30 impregnated with dry preventing agent according to the invention is pressingly inserted in the bottom annular space 32 below the partitioning wall 18. The dry preventing agent preferably has a volatile property an consists of at least one component of a solvent of ink held in the ink reservoir 14. As the impregnation receptacle 30, materials listed below exhibit an excellent liquid holding property, and thus are advantageous in holding dry preventing agent in a greater quantity.

A) High water absorptive resin:

starch graft acrylate copolymer, starch CMC acrylate crosslinking agent, acrylic soda polymer, acrylic soda, acrylamide copolymer, acrylic vinyl alcohol copolymer, etc.

B) Porous high molecular resin:

porous urethane, sintered vinylidene fluoride, porous polyolefin, etc.

C) Fibrous filter;

filters made by bundling suitable synthetic fibers (polyester fiber, polypropylene fiber, polyethylene fiber, and the like), etc.

D) Porous high molecular resin containing the above high water absorptive resin therein; and E) Fibrous filter containing the above high water absorptive resin therein.

In place of the impregnation receptacle 30 as described above, it may be appropriate to gelatinize the dry preventing agent into the same annular form as the impregnation receptacle and to fill the annular space 34 with the gelatinized dry preventing agent. This is advantageous in that the impregnation receptacle 30 can be dispensed with and the dry preventing agent is not externally scattered even if an impact is given thereon such as when the liquid applicator falls inadvertently.

Figure 3:
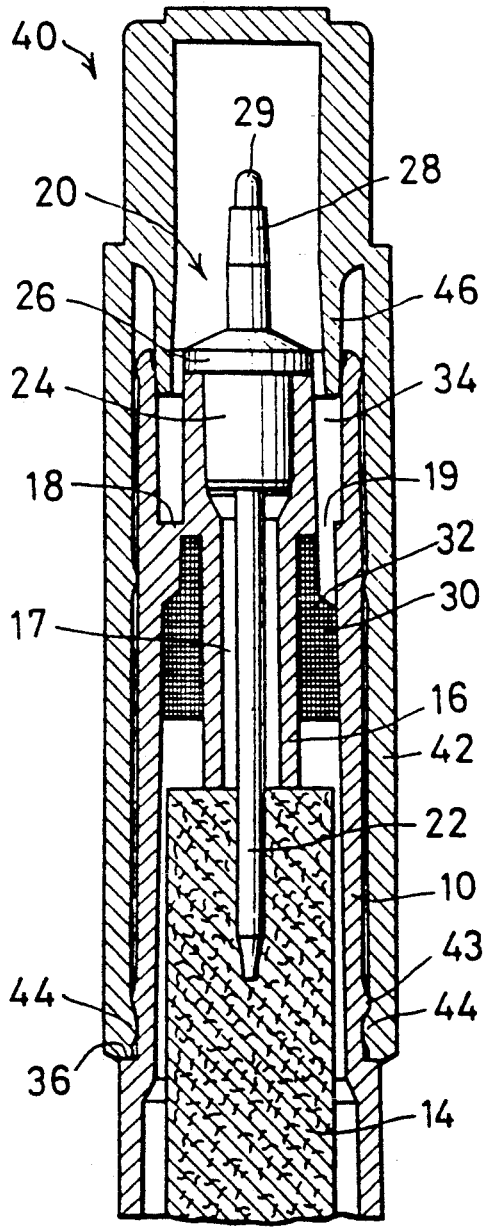
FIG. 3 is a partial front view in section showing a state where a cap is mounted on the applicator.

On the other hand, as shown in FIG. 3, a cap 4 mountable on the main body container of the liquid applicator includes a hollow outer cylindrical portion 42 and a hollow inner cylindrical portion 46. The outer cylindrical portion 42 is longer than the inner cylindrical portion 46, and the inside diameter thereof is substantially equal to the outside diameter of the casing 10. The outer cylindrical portion 42 has a projected portion 44 formed on an inner surface of a lead end portion thereof. The projected portion 44 projects inward and extends over an entire circumference of the inner surface of the outer cylindrical portion 42. On the contrary, a stepped portion 36 is formed on an outer surface of the casing 10 and a projected portion 43 is formed right above the stepped portion 36. The projected portion 43 projects outward and extends over an entire circumference of the outer surface of the casing 10. The cap 40 is completely mounted on the casing 10 in a state where the projected portion 44 moves over the projected portion 43 and a lead end of the outer cylindrical portion 42 is in contact with the stepped portion 36.

The outside diameter of the inner cylindrical portion 46 is substantially equal to the inside diameter of the casing 10 defining the lead annular space 34. In a state where the outer cylindrical portion 42 is fitted to the casing 10, the inner cylindrical portion 46 is inserted into the annular space 34 and thereby the outer surface thereof is sealably in contact with the inner surface of the casing 10. In this way, the nib 29 and the dry preventing agent are held airtight within the cap 40.

Even if the liquid applicator thus constructed is left uncapped with the cap 40 for a long time, the dry preventing agent held by the impregnation receptacle 30 or the gelatinized dry preventing agent itself evaporates and oozes out of the lead annular space 34, thereby coating the exposed surface of the nib 29. This suppresses the drying of the nib 29 caused by the condensation or solidification of the ink at the nib 29, thereby preventing the scratching phenomenon. In addition, the dry preventing agent gives almost no influence on the performance of the ink because it is not directly mixed with the ink.

The following effects are obtainable in this embodiment.

(a) Since the casing 10 is required to have fine air supply holes so as to supply the air to the ink reservoir 14 contained therein, there is the undesirable possibility that the ink in the ink reservoir 14 evaporates through the air supply holes. However, in this embodiment, since the impregnation receptacle 30 holding the dry preventing agent or gelatinized dry preventing agent is provided within the casing 10, vapors of the dry preventing agent coat and prevent the in k reservoir from drying. Thus, the life of the ink reservoir 14 can be extended.

(b) The dry preventing agent is in communication with the atmosphere through the communication hole 19 and the lead annular space 34. Accordingly, in the case where the dry preventing agent is reduced in quantity due to the evaporation and the effect thereof is weakened, the dry preventing agent can be replenished easily through the lead annular space 34.

(c) Since the inner cylinder 16 is provided between the pen core 22 and the dry preventing agent, the dry preventing agent mixing with the ink contained in the pen core 22 can be prevented, even in a structure wherein the side surface of the pen core 22 is exposed.

(d) In order to enhance the airtightness, it is desirable that the cap 40 has a portion to be fitted to the casing 10 (projected portion 44 in the illustrated example) and a portion to be sealably fitted to the casing 10 (inner cylindrical portion 46 in the illustrated example), and that the sealably fitted portion is sized with high accuracy. According to the above construction, the lead annular space 34 for oozing out the dry preventing agent therethrough can be utilized as a portion to which the inner cylindrical portion 46 is inserted. Accordingly, the airtightness within the mounted cap 40 can be attained effectively by sealably fitting the outer surface of the inner cylindrical portion 46 to the inner surface of the casing facing the annular space 34.

Results of an experiment are shown below in order to clarify the effects of the above liquid applicator.

With respect to a case where a dye ink is used, the scratching phenomenon was studied for an existing liquid applicator not using the dry preventing agent, a liquid applicator including the impregnation receptacle 30 impregnated with the dry preventing agent, and a liquid applicator filled with the gelatinized dry preventing agent respectively. Respective conditions are as shown in TABLE 1 below:

TABLE 1

| | |
|---|---|
| COMPOSITION OF INK (DYE INK) | |
| ETHYLENE GLYCOL | 20 WEIGHT PARTS |
| GLYCEROL | 10 WEIGHT PARTS |

TABLE 1-continued

| | |
|---|---|
| WATER | 61.9 WEIGHT PARTS |
| EOSIN | 5 WEIGHT PARTS |
| TARTRAZINE | 2 WEIGHT PARTS |
| NOIGEN EA112 (PRODUCED BY DIICHI KOGYO SEIYAKU KABUSHIKI KAISHA, POLYETHYLENE ALKYLPHENOLETHYL) | 0.1 WEIGHT PART |
| BENZOIC SODA | 1 WEIGHT PART |
| IMPREGNATION RECEPTACLE | |
| SIMICAGEL N-100 (HIGH WATER ABSORPTIVE RESIN PRODUCED BY SUMITOMO KAGAKU KOGYO KABUSHIKI KAISHA) IS CONTAINED IN FIBROUS FILTER | |
| COMPOSITION OF DRY PREVENTING AGENT HELD BY IMPREGNATION RECEPTACLE | |
| WATER | 75 WEIGHT PARTS |
| POLYVINYL ALCOHOL | 12 WEIGHT PARTS |
| ETHYLENE GLYCOL | 23 WEIGHT PARTS |
| COMPOSITION OF GELATINIZED DRY PREVENTING AGENT | |
| WATER | 84 WEIGHT PARTS |
| POLYVINYL ALCOHOL | 3 WEIGHT PARTS |
| ETHYLENE GLYCOL | 10 WEIGHT PARTS |
| SIMICAGEL N-100 (GELATINIZER) | 3 WEIGHT PARTS |

When left uncapped at room temperature, the existing liquid applicator not using the dry preventing agent suffered the scratching phenomenon after 45 minutes. As opposed to this, it was recognized that the liquid applicators including the impregnation receptacle 30 impregnated with the dry preventing agent and including the gelatinized dry preventing agent, which had been left uncapped for 9 hours, exhibited the same writing performance as exhibited 9 hours before.

Next, a similar experiment was conducted using a pigment ink. Composition of the pigment ink is as shown in TABLE 2 below.

TABLE 2

| | |
|---|---|
| AMINE SALT OF STYRENE-BUTYLACRYLATE-METHACRYLIC ACID COPOLYMER (MOLE RATIO 80:40:80) | 10 WEIGHT PARTS |
| ETHYLENE GLYCOL | 20 WEIGHT PARTS |
| WATER | 40 WEIGHT PARTS |
| CARBON BLACK | 16 WEIGHT PARTS |
| UREA | 14 WEIGHT PARTS |

Those listed in TABLE 2 were subject to a dispersion process for 80 hours in a ball mill. Further, 20 weight parts of ethylene glycol and 40 weight parts of water were added, and the resultant was subjected to a dispersion process for 20 hours.

When the thus obtained pigment ink is used, the existing liquid applicator not using the dry preventing agent had the scratching phenomenon after 15 minutes when left uncapped at room temperature. However, it was found that any of the liquid applicators including the impregnation receptacle 30 impregnated with the dry preventing agent and including the gelatinized dry preventing agent, which had been left uncapped at room temperature for 3 hours, exhibited the same writing performance as exhibited 3 hours before.

Figure 4:
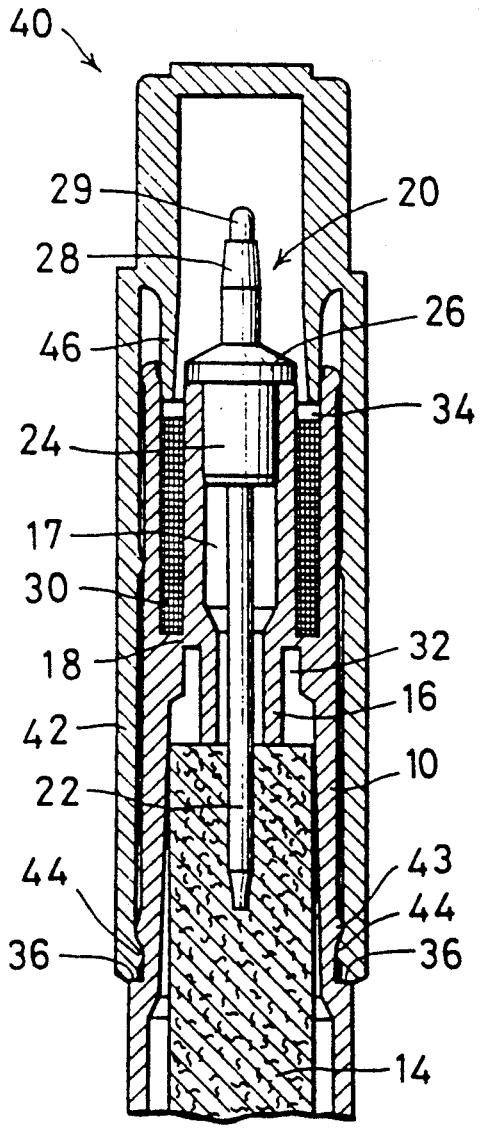
FIG. 4 is a partial front view in section showing a second liquid applicator embodying the invention.

A second embodiment of the invention will be described with reference to FIG. 4. In this embodiment, no communication hole 19 is formed in a partition wall 18, and a bottom annular space 32 and a lead annular space 34 are completely separated by the partition wall 18. The lead annular space 34 is defined in a hollow annular portion who vertical cross-section is U-shaped. The lead annular space 34 is filled with an annular impregnation receptacle 30 holding the dry preventing agent or gelatinized dry preventing agent.

In the liquid applicator thus constructed, the surface of a nib 20 is coated with vapors of the dry preventing agent filled in the lead annular space 34. Accordingly, the drying of the nib 29 can be suppressed, thereby preventing the scratching phenomenon.

An experiment was conducted for the second embodiment under the conditions (composition of the ink, of the dry preventing agent, and of the impregnation receptacle) similar to those in the experiment conducted for the first embodiment in order to study the scratching phenomenon. When the dye ink was used, it was recognized that the liquid applicators including the impregnation receptacle 30 impregnated with the dry preventing agent and including the gelatinized dry preventing agent, which had been left uncapped for 6 hours, both exhibited the same writing performance as they had exhibited 6 hours before. Further, when the pigment ink was used, it was recognized that the liquid applicators including the impegnation receptacle 30 impregnated with the dry preventing agent and including the gelatinized dry preventing agent, which had been left uncapped for 2 hours, both exhibited the same writing performance as they had exhibited 2 hours before.

Figure 5:
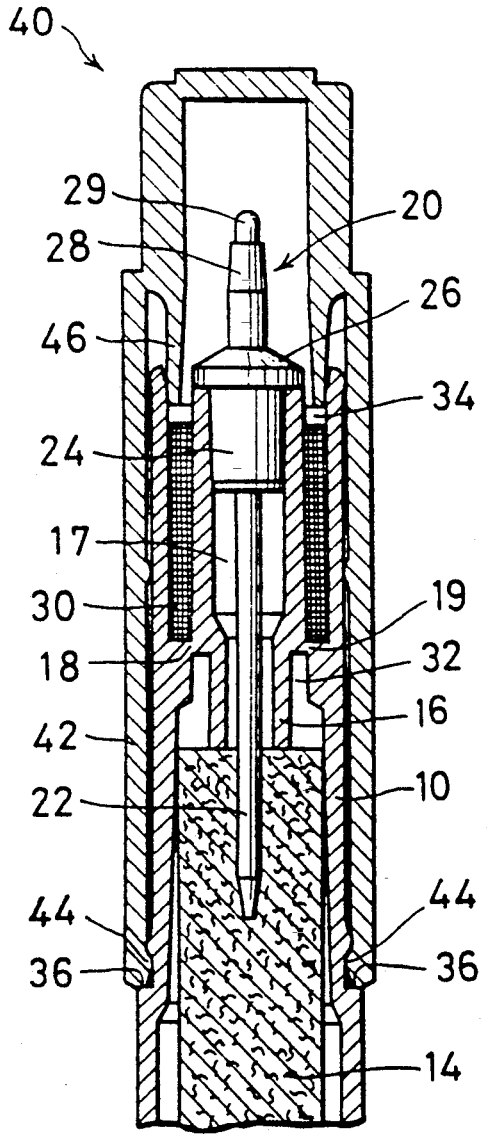
FIG. 5 is a partial front view in section showing a modification of the second liquid applicator.

If the communication holes 19 are formed in the partition wall 18 of the second embodiment as shown in FIG. 5, the construction of the liquid applicator is similar to the first embodiment in which the dry preventing agent is filled in the lead annular space 34 instead of the bottom annular space 32. Similar to the foregoing embodiments, the drying of the nib 29 can be effectively suppressed in this case. It goes without saying that the drying of the nib 29 can be suppressed more effectively if the dry preventinq agent is filled in both the lead annular space 34 and the bottom annular space 32 in the construction of the first embodiment.

Figure 6:
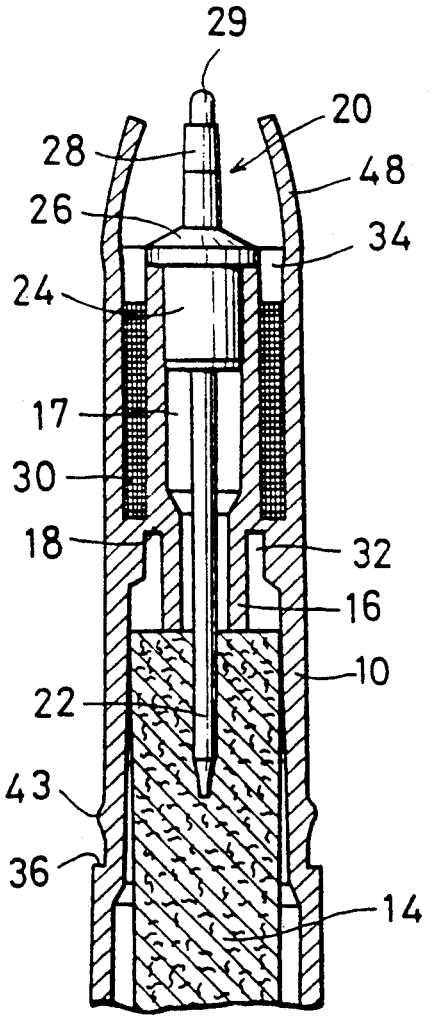
FIG. 6 is a partial front view in section showing a third liquid applicator embodying the invention.

A third embodiment of the invention will be described with reference to FIG. 6. In this embodiment, a covering portion 48 extends in a leading direction from the lead end face of the casing 10 in the second embodiment. This covering portion 48 if formed such that the diameter thereof gradually decreases as it extends more toward the leading end of the liquid applicator, and extends up to the vicinity of the nib 29.

With the above construction, vapors of the dry preventing agent from a lead annular space 34 can be introduced to the nib 29 more actively by the presence of the covering portion 48, thereby more reliably preventing the nib 29 from drying. The covering portion 48 can be additionally provided in the construction of the first embodiment readily and easily.

The invention is not limited to the foregoing embodiments, but may be embodied in the following manners, for example.

(1) In the foregoing embodiment, the inner cylinder 16 is provided at the lead end portion of the casing 10, the pen shaft 20 is inserted into the inner cylinder 16, and the dry preventing agent is filled outside the inner cylinder 16. However, in the case where the pen core 22 of the pen shaft 20 is covered by a coating material, it may be appropriate to omit the inner cylinder 16 from the construction and to fill the dry preventing agent right outside the pen core 22.

(2) The type of liquid to be applied does not matter according to the invention. For example, when the in is used in the liquid applicator, either oil ink or the water ink can be used.

(3) The cross-sections of the main body container and the inner cylinder do not matter according to the invention. Similar to the foregoing embodiment, the invention is applicable to the liquid applicator having a main body container and an inner cylinder whose cross-sections are elliptic or polygonal.

(4) In the foregoing embodiments, the ink is held by the ink reservoir 14. However, the ink may be directly filled in the casing 10, for example, in the construction shown in the second embodiment.

As described above, according to the invention, a dry preventing agent having a volatile property is provided at a lead end portion of a casing of a liquid applicator around an applicator shaft, to thereby coat a nib of the applicator shaft with vapors of the dry preventing agent so as to prevent the nib from getting dried. Accordingly, even if the liquid applicator is left uncapped while being used, a user is allowed to start the interrupted liquid application operation immediately without encountering the scratching phenomenon. Further, since the dry preventing agent is not directly mixed with the liquid to be applied, provision of the dry preventing agent in the liquid applicator has an extremely small influence on the performance of the liquid to be applied.

Particularly, when the dry preventing agent consists of at least one component of the liquid to be applied, almost no influence is given on the performance of the liquid to be applied.

When the dry preventing agent is impregnated in an impregnation receptacle, the impregnation receptacle is allowed to have an improved capability of holding the dry preventing agent if the impregnation receptacle is formed by any one of a high water absorptive resin, a porous high molecular resin, a fibrous filter, a porous high molecular resin containing the high water absorptive resin therein, and a fibrous filter containing the high water absorptive resin. This increases an amount of the dry preventing agent held by the impregnation receptacle, thus reinforcing the dry preventing agent effect and extending a duration during which the liquid applicator can be left uncapped and a lift of the liquid applicator itself.

If the gelatinized dry preventing agent is filled, the impregnation receptacle can be dispensed with, thereby contributing to reduction in a production cost of the liquid applicator, and the dry preventing agent can be replenished easily. As opposed to the liquid applicator including the impregnation receptacle impregnated with the dry preventing agent, this liquid applicator is advantageous in preventing the dry preventing agent from scattering even if an impact is given thereon such as when the liquid applicator falls inadvertently.

Further, the dry preventing agent can be filled in a recessed portion spaced away from the applicator shaft. The is prevents the liquid being held in the applicator shaft from being mixed with the dry preventing agent, thereby preventing the dry preventing agent from affecting the performance of the liquid to be applied more reliably.

If the vapors of the dry preventing agent are introduced to the liquid to be applied contained in the casing, evaporation of the liquid to be applied in the casing can be suppressed. This is effective in further extending the life of the liquid applicator.

When a cap is mounted on the casing, an inner cylindrical portion of a cap can be made insertable into a lead annular space defined in the casing, and an outer surface of the inner cylindrical portion of the cap is sealably in contact with an inner surface of the casing. Accordingly, a nib and the dry preventing agent can be held airtight within the cap in an inexpensive construction using the lead annular space efficiently.

If a covering portion is provided which extends up to the vicinity of the nib of the liquid applicator and is formed such that the diameter thereof decreases gradually as it extends more toward the nib, the vapors of the dry preventing agent can be introduced around the nib more reliably, thereby suppressing the drying of the nib more effectively.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A liquid applicator comprising:

a main body container having a liquid reservoir portion for containing liquid to be applied;

applicator shaft supporting means provided inside of the main body container and in a forward position of the liquid reservoir portion for supporting an applicator shaft communicating with the liquid reservoir portion and having a nib;

the applicator shaft supporting means comprising a hollow cylinder provided inside of a lead end portion of the main body container and adapted for holding the applicator shaft therein, the hollow cylinder having an outer diameter smaller than an inner diameter of the liquid reservoir portion of the main body container, and defining a space between the hollow cylinder and main body container;

a cap mountable on the main body container for covering the nib of the applicator shaft; and a mass of volatile drying prevention agent provided in the space between the main body container and the hollow cylinder;

whereby vapor of the drying prevention agent oozes to the nib of the applicator shaft and prevents the nib of the applicator shaft from drying out.

2. A liquid applicator as defined in claim 1 wherein the dry preventing agent consists of at least one component of the liquid to be applied.

3. A liquid applicator as defined in claim 1 wherein a covering portion extending up to the vicinity of the lead end of the liquid applicator is provided at a lead end of the main body container, the covering portion being formed such that the diameter thereof decreases as it extends toward the load end of the liquid applicator.

4. A liquid applicator as defined in claim 1, wherein the applicator shaft supporting means further comprises a partition wall for connecting the hollow cylinder with the main body container while air tightly closing the liquid reservoir portion; and wherein the mass of drying prevention agent is provided in a forward position of the partition wall.

5. A liquid applicator as defined in claim 4, wherein the drying prevention agent fills the entire space between the hollow cylinder and the main body container.

6. A liquid applicator as defined in claim 4, wherein the liquid reservoir portion further comprises a liquid reservoir member, and the hollow cylinder extends to a forward end of the liquid reservoir member so as to keep the liquid reservoir member from moving forward.

7. A liquid applicator as defined in claim 1, wherein the applicator shaft supporting means further comprises connecting ribs connecting the hollow cylinder with the main body container; and the mass of drying prevention agent being provided in an air tight manner in the space between the hollow cylinder and the main body container so as to close the liquid reservoir portion;

whereby vapor of the drying prevention agent oozes to both the nib of the applicator shaft and the liquid reservoir portion to prevent the nib of the applicator shaft and the liquid reservoir portion from drying out.

8. A liquid applicator as defined in claim 7, wherein the liquid reservoir portion further comprises a liquid reservoir member, and the hollow cylinder extends to a forward end of the liquid reservoir member so as to keep the liquid reservoir member from moving forward.

9. A liquid applicator as defined in claim 1, wherein the drying prevention agent is impregnated in an impregnation receptacle.

10. A liquid applicator as defined in claim 9 wherein the impregnation receptacle is formed by any one of a high water absorptive resin, a porous high water absorptive resin, a fibrous filter, a porous high molecular resin containing the high water absorptive resin therein, and a fibrous filter containing a high water absorptive resin therein.

11. A liquid applicator as defined in claim 1, wherein the drying prevention agent is provided in a gelatinized state in the space between the hollow cylinder and the main body container.

12. A liquid applicator as defined in claim 1 wherein the main body container is in the form of a cylinder; the cap comprises a hollow outer cylindrical portion and a hollow inner cylindrical portion, the hollow outer cylindrical portion being fittable on an outer circumferential surface of the main body container, the hollow inner cylindrical portion being coaxial with and having a small diameter than the hollow outer cylindrical portion, the hollow inner cylindrical portion being insertable into the space between the hollow cylinder and the main body container; and the outside diameter of the inner cylindrical portion is set such that an outer circumferential surface of the inner cylindrical portion is in sealing contact with an inner circumferential surface of the main body container facing the space in a state where the outer cylindrical portion is fitted to the outer circumferential surface of the main body container.

* * * * *